United States Patent [19]

Krieger

[11] 4,339,968

[45] Jul. 20, 1982

[54] HYDRAULIC TORQUE MULTIPLIER WRENCH

[76] Inventor: Willard Krieger, 3965 Cody St., Wheatridge, Colo. 80033

[21] Appl. No.: 170,623

[22] Filed: Jul. 21, 1980

[51] Int. Cl.[3] ..... B25B 13/46

[52] U.S. Cl. ..... 81/57.39

[58] Field of Search ..... 81/57.39; 92/117 A, 92/117 R, 138; 91/39, 216 B

[56] References Cited

U.S. PATENT DOCUMENTS

| | | | |
|---|---|---|---|
| 2,804,051 | 8/1957 | Lushansky | 92/117 A |
| 2,961,904 | 11/1960 | Sergan | 81/57.39 |
| 3,003,428 | 10/1961 | Christenson | 92/138 |
| 3,564,953 | 2/1971 | Able | 81/57.39 |
| 4,200,011 | 4/1980 | Wilmeth | 81/57.39 |

FOREIGN PATENT DOCUMENTS

| | | | |
|---|---|---|---|
| 580426 | 8/1958 | Italy | 92/138 |

*Primary Examiner*—James L. Jones, Jr.
*Attorney, Agent, or Firm*—Crandell & Polumbus

[57] ABSTRACT

A power wrench includes a relatively flat elongated housing with an output shaft at one end operatively connected to one end of a drive segment lever arm whose opposite end is connected to a hydraulic cylinder mounted transverse to the lever arm. The hydraulic cylinder is connected through hydraulic lines to an external reservoir which is subject to variable hydraulic pressures through a power source. A valve alternately admits hydraulic fluid to opposite ends of the cylinder causing the cylinder to reciprocate which in turn oscillates the aforementioned opposite end of the lever arm to unidirectionally rotate the output shaft.

3 Claims, 6 Drawing Figures

HYDRAULIC TORQUE MULTIPLIER WRENCH

BACKGROUND OF THE INVENTION

1. Field of the Invention

This invention relates generally to wrenches and more particularly to wrenches of the type wherein a fluid input reciprocably drives a lever arm which unidirectionally turns an output shaft adapted to be operatively engaged with a driven object such as a work tool, e.g. a removable socket.

2. Description of the Prior Art

Manual ratchet-type wrenches are adapted to apply a torque through a lever arm, directly to a socket placed over a bolt or nut to be threadably tightened. Electric motors and hydraulic or pneumatic reciprocating or rotating power sources have been utilized to greatly increase the torque applied directly to the socket. These power sources apply torque to tighten the nut or bolt about the longitudinal axis of the threaded connection to be made.

Ratchet-type wrenches connectable to a pressurized hydraulic fluid source are also known in the art wherein the pressurized fluid is utilized to reciprocate a piston within a cylinder to drive a lever arm. Such wrenches utilize the reciprocating piston and cylinder combination to in turn reciprocably move a pawl which tangentially impacts a ratchet drive wheel, turning the nut or bolt to be tightened. The ratchet-type wrenches of this type which are currently available do not maximize the torque available from the force of the reciprocating piston since a relatively small mechanical advantage is available between the input force and the torque applied to the nut or bolt, the lever arm being relatively short. The lever arm of the prior art extends laterally away from the longitudinal axis of the wrench. The piston-cylinder combination is located along a side of the wrench, connecting to the lever arm. Because the lever arm is perpendicular to the length of the wrench, keeping the prior art hydraulic wrenches relatively wide, the lever arm is ideally kept relatively short in order to keep the size of the wrench within limits.

A further shortcoming of prior art hydaulic wrenches is the fact that the oscillating input force arises from the piston reciprocating within the cylinder. The piston must work the pawl at one end of the piston-cylinder combination. This arrangement requires a pivoting connection at the other end of the piston-cylinder combination, because the overall length of the piston-cylinder combination changes as the piston extends to impact the pawl. Pivotably connecting one end of the combination allows for automatic adjustment to this change in overall length.

The prior art hydraulic wrenches use a conventional piston reciprocating within a cylinder. Not only must the piston-cylinder combination be pivoted, as discussed above, but the combination must also be guarded for safety. The prior art does guard the piston-cylinder, but does not completely enclose them to provide a fail safe system.

It is often useful to use wrench extensions to reach out of the way threaded connections. An example of such a connection would be the main bearing nuts on some diesel engines, which are accessible only through small doors in the side of the crank case.

Wrenches using the hydraulic principle previously known in the art and discussed briefly above, are of some advantage in that flexible hydraulic lines can be used as an extension means, but because of the lateral position of the hydraulic cylinder the wrench itself is wide at the output end and therefore not acceptable in some situations.

Socket wrenches adaptable as wrench extensions are shown in reissue Pat. No. 23,661, issued May 26, 1953 to E. T. Able et al. and U.S. Pat. No. 3,564,953 which issued Feb. 23, 1971 to E. T. Able. Both of the preceding patents utilize a rotary power source releasably connected to the input end of the extension to turn the output end of the extension.

Hydraulic pressure is particularly suitable to certain situations encountered in industry. It is often necessary as a result of specifications for a given piece of machinery to apply a set amount of torque to a threaded connection. Torque applied to a given nut or bolt is directly related to hydraulic pressure. Hydraulic pressure can be calibrated to specific values of torque with relative ease, as compared with other motive inputs.

OBJECTS AND SUMMARY OF THE INVENTION

The principal object of the present invention is to therefore provide a hydraulic wrench with an augmented mechanical advantage.

Another object of the present invention is to provide a wrench which can apply a preselected amount of torque to a threaded connection.

A further object of the present invention is to provide a new and improved, compact unidirectional hydraulic wrench for tightening or loosening a threaded connection.

A still further object of the present invention is to increase the safety of using a hydraulic wrench by enclosing as many moving parts as possible within a housing.

The hollow elongated housing assembly has an upper portion and a lower portion, which are substantially mirror images of each other. The elongated housing has an output end and an input end with the output end having the output shaft whose longitudinal axis is perpendicularly disposed relative to a longitudinal axis of the housing assembly. The output shaft is rotatably mounted in the output end and has an output shaft bore formed along the longitudinal axis of the output shaft. The output shaft bore is adapted to receive a nut socket at either extremity or end, so that depending on the end used, one can either tighten or untighten a threaded connection. The output end has, in addition to the output shaft, a ratchet drive wheel splined onto the output shaft.

Intermediate the output end and the input end and retained within the housing assembly, is the drive segment lever arm which pivots freely about the output shaft. At the output end of the drive segment is mounted a pawl, which is urged into contact with the ratchet drive wheel by a pawl spring also mounted within the drive segment. At the input end of the drive segment, the drive segment is connected to and pivoted about the output shaft by the cylinder reciprocating about the fixed piston.

The piston is rigidly mounted on a rod extending along the longitudinal axis of the cylinder with the rod being supported at its ends on the housing so that the cylinder can be reciprocably moved along the rod. A hydraulic line is fixed to each end of the cylinder to allow communication between the interior of the cylinder and a reservoir of hydraulic fluid held under pressure by a power source.

In accordance with the objects of the present invention, a hollow elongated housing encloses an output shaft rotatable within one end. An elongated drive segment is axially aligned with the longitudinal axis of the output shaft and extends away therefrom to connect to a cylinder reciprocable about a fixed piston. Reciprocation of the cylinder oscillates the drive segment to unidirectionally rotate the output shaft.

One end and then the other of the cylinder are fed hydraulic fluid under pressure through a valve. The valve may be operated by a timer which can be set to feed the hydraulic fluid to either end for a set period of time depending on the amount of force to be applied to the threaded connection.

DESCRIPTION OF THE PREFERRED EMBODIMENTS

Figure 1:
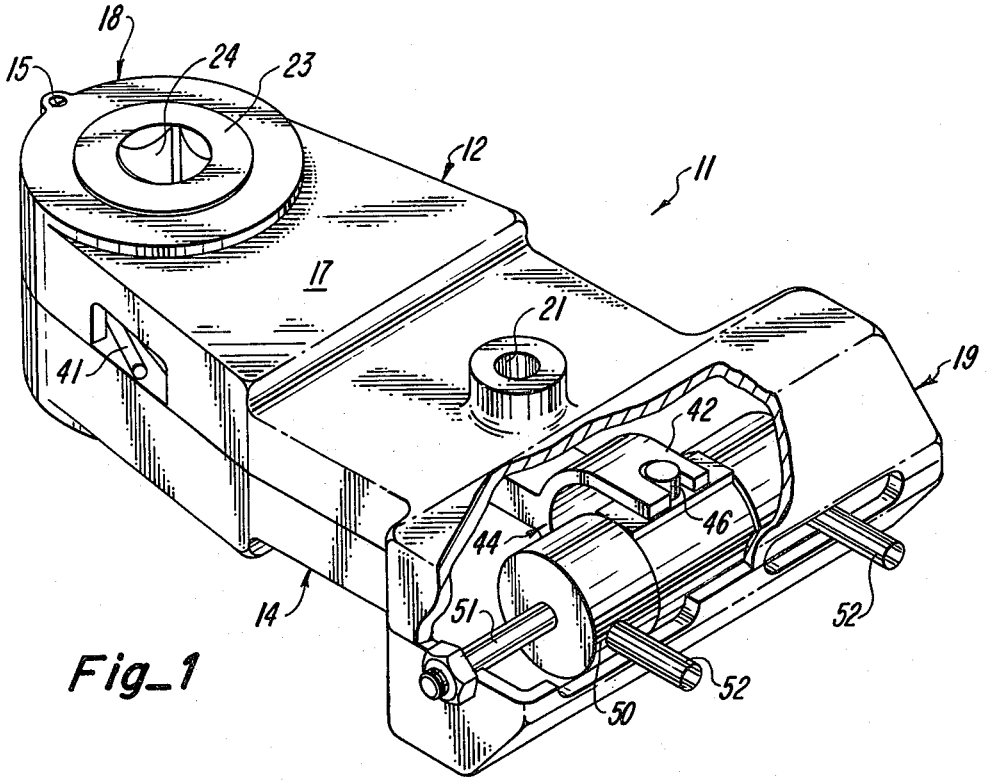
FIG. 1 is a perspective view of the present invention with parts broken away for clarity.

A hydraulic torque multiplier wrench 11 is shown in FIG. 1 having an upper housing 12 and a lower housing 14 of substantially similar but opposite configuration. Cap screws 15 interconnect the upper housing 12 to the lower housing 14 through screw holes 16 to form an elongated relatively flat encasement or housing assembly 17.

Figure 4:
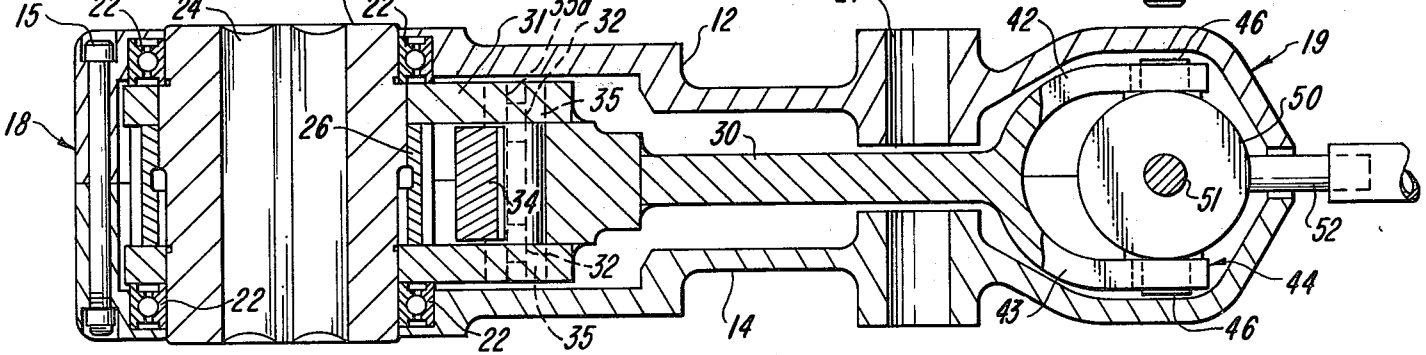
FIG. 4 is a section taken along line 4—4 of FIG. 3.

The housing assembly 17 is further defined by a generally rounded output end 18 and an input end 19. Longitudinally intermediate the output end and the input end are a pair of anchor pin bores 21, one integrally formed in the upper housing 12 and one integrally formed on the lower housing 14 as seen in FIG. 4. The anchor pin bores 21 are adapted to receive pins, not shown, which can be interconnected between an object or structure on which work is being done and the hydraulic torque multiplier wrench 11 to thereby fix the wrench 11 relative to the object or structure.

Figure 3:
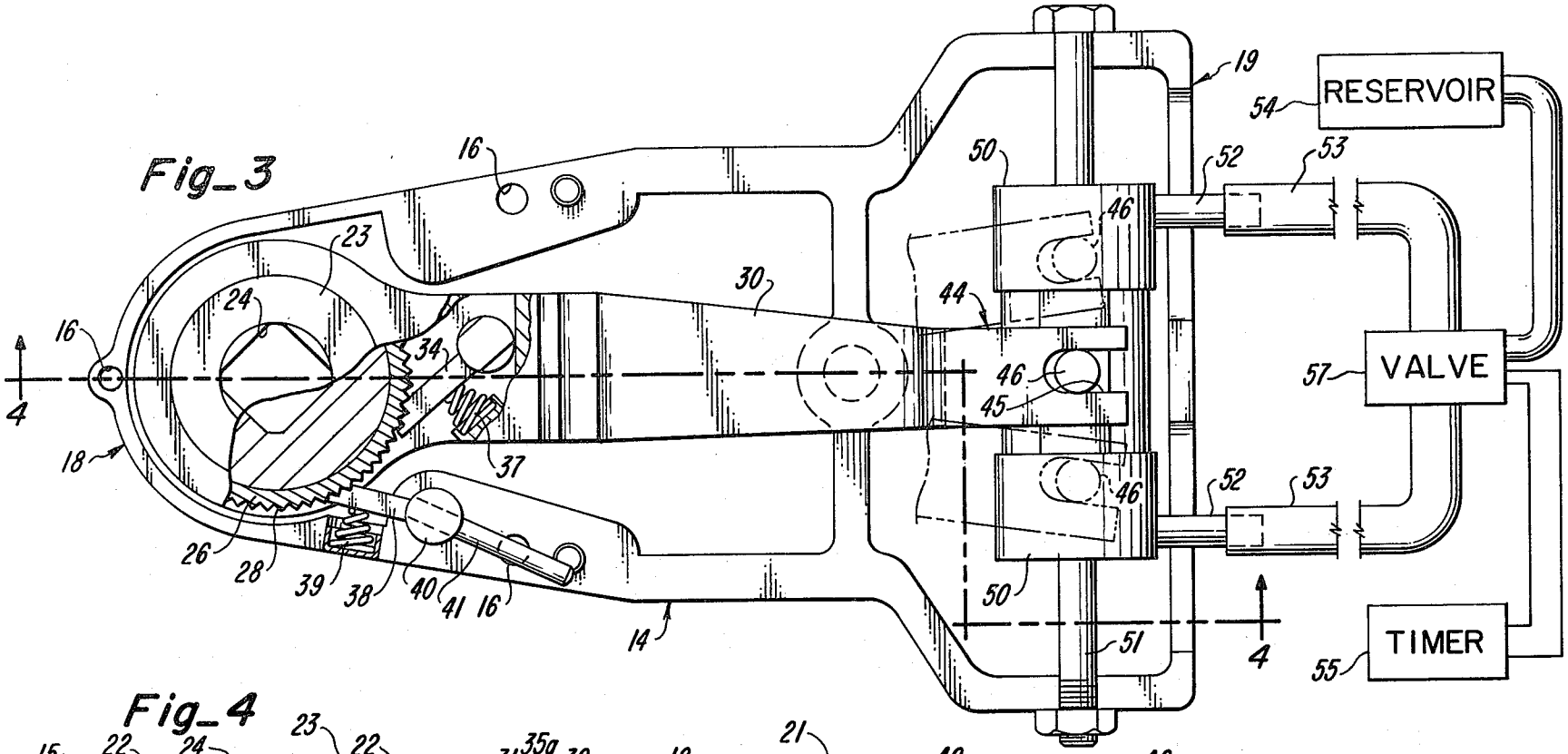
FIG. 3 is a top plan view of the hydraulic torque wrench of the present invention without an upper housing, portions of a drive segment being broken away for clarity.

Referring to FIGS. 3 and 4, the output end 18 can be seen to retain a generally cylindrical output shaft or member 23, whose axis is perpendicular to the flat housing assembly 17. The output shaft 23 is journaled between the upper and lower housings 12 and 14 through encased ball bearings 22, as seen in FIG. 4. Concentric with the longitudinal axis of the output shaft 23 is an output shaft bore 24 formed in the output shaft 23. The bore 24 is of square cross section, extending to both end surfaces of the output shaft 23 adjacent to the upper and lower housings 12 and 14. The output shaft bore 24 is adapted to releasably receive a conventional socket (not shown) in a manner well known in the art.

A ratchet means drive wheel 26 is splined onto the outer surface of the output shaft 23 for unitary rotation therewith. The ratchet drive wheel 26 has a plurality of teeth 28 around its circumference and is symmetric with respect to a horizontal plane bisecting the housing assembly 17.

A drive segment or lever arm 30 extends between the input and output ends 18 and 19 of the housing 17. The drive segment 30 is oscillated back and forth at the input end 19 to rotate the output shaft 23 at the output end 18 in a manner to be described hereinafter.

The drive segment 30 is a relatively narrow elongated member of strong rigid construction extending longitudinally of the housing 17. At an output end of the drive segment 30, it is integrally connected, as by welding, to a pair of superimposed concentric rings 31. The rings 31 rotatably fit about the outer circumference of the output shaft 23. The rings 31 are vertically spaced so that the ratchet drive wheel 26 is disposed therebetween.

Each of the superimposed rings 31 has a relatively small diameter bore slightly removed toward the input end 19 for receiving a cylindrical spacer or plug 35 of the same height as the respective ring's thickness. In between the spacers 35 is placed a pawl 34 having a cylindrical portion of the same diameter as the spacers 35, the cylindrical portion spanning the distance between rings 31. Spacers 35 and the cylindrical portion of the pawl 34 have axially aligned bores **35*a* extending along their longitudinal axes which bores rotatably receive a pair of roll pins 32 which interlock the spacers and pawl. The multi-piece construction described permits the pawl 34 to be placed between the rings 31 during assembly, and then fixed in position by the spacers 35 and pins 32**.

The pawl 34 has an arm portion **34*a* extending away from the cylindrical portion which engages the teeth 28 of the ratchet drive wheel 26 at the urging of a pawl spring 37. The pawl spring 37 is mounted in the space between the rings 31 of the drive segment 30, like the pawl 34, and is perpendicular to the pawl, as seen in FIG. 3**.

A backlash lever 38 (FIG. 3), is mounted at one side of the housing 16 between upper and lower housings 12 and 14, and is adapted to engage the ratchet drive wheel 26 at the urging of spring 39 mounted within the lower housing 14 perpendicular to the backlash lever. The backlash lever 38 prevents the wrench 11 from moving relative to ratchet drive wheel 26 as the pawl 34 returns to a start position.

It will be understood that the pawl 34 moves the ratchet drive wheel 26 through short arcs as the drive segment 30 is oscillated. After each arc of movement, the pawl 34 returns to the start. Only during the movement of the pawl 34 through these arcs, does the pawl engage and rotate the ratchet drive wheel 26. When not being rotated, the ratchet drive wheel 26 must be held in position by the backlash lever 38 until the next oscillation of the drive segment in which forces are applied to the drive wheel 26.

The backlash lever 38 is fixed to a pawl release post 40, which pivotably mounts the backlash lever between the upper housing 12 and lower housing 14. A taper pin 41 mounted to the post 40 extends generally diametrically away from the backlash lever 38 through a recess (FIG. 1) in the upper housing 12 to a position where the user of the hydraulic wrench 11 can push the taper pin 41 and rotate the backlash lever 38 about the post 40 and away from engagement with the drive wheel 26, releasing the backlash lever 38 from the ratchet drive wheel 26. Pushing the taper pin to release the backlash lever 38 from the ratchet drive wheel 26 may be required to relieve impressed torque on the output shaft 23 when the hydraulic wrench 11 is ready to be released from the work.

At the input end 19, the drive segment 30 is bifurcated forming an upper fork or forked portion 42 and a lower fork or forked portion 43 defining a forked end 44. The upper and lower forks are identical integral extensions of the drive segment 30 (FIG. 4). Both the upper and lower forks 42 and 43 have a longitudinal slot 45 at their distal ends. The slots receive a pair of pins 46 which are integrally connected to the top and bottom of a cylinder member 50.

Figure 2:
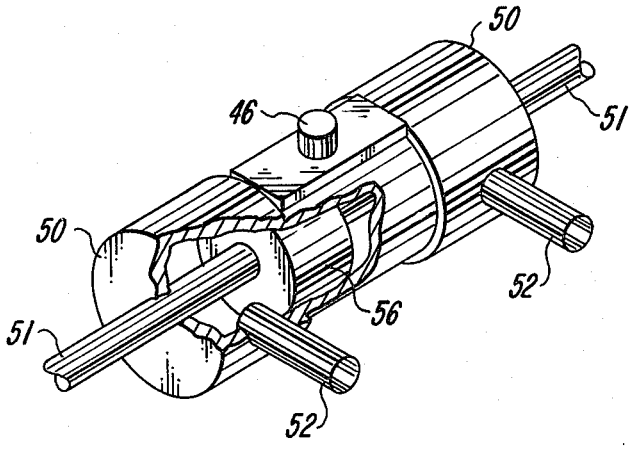
FIG. 2 is a fragmentary perspective view of a piston-cylinder combination of the hydraulic torque wrench of the present invention, portions of the cylinder being broken away for clarity.

The cylinder 50 is essentially perpendicular to the drive segment 30 and is bisected by a plane which also bisects the housing assembly 16 between the upper and lower housings 12 and 14. The cylinder is placed between the upper and lower forks 42 and 43 and is slideable on an axial piston rod 51, which is interconnected between opposite sides of the housing assembly 16 by nuts threaded onto exposed ends of the piston rod. A piston 56 (FIG. 2) is integrally attached to the rod 51 at its longitudinal center and forms a sliding sealed relationship with the interior surface of the cylinder 50. Extending laterally away from opposite ends of the cylinder 50 are hydraulic line connections 52 which allow for hydraulic fluid communication between the cylinder 50 and a reservoir 54 of hydraulic fluid via hydraulic lines 53. The novel use of a cylinder reciprocating about a piston along a fixed rod reduces the moving parts of the piston-cylinder combination over the prior art, which pivoted the entire piston-cylinder combination at one end. The mounting method also allows the piston-cylinder combination to be completely enclosed in the housing 17, which adds a safety factor to the wrench 11.

Between the reservoir 54 and the hydraulic lines 53 is a four-way solenoid valve 57, such as of the type manufactured by Racine Fluid Power Products, Rexnord, Inc., of Racine, Wisconsin under the designation Racine No. 004-DTHS-1025. The valve alternately admits fluid to one end while bleeding fluid from the other end and then admits fluid to the other end while bleeding fluid from the one end. The valve in this manner controls the flow of hydraulic fluid from the reservoir 54 to the cylinder 50. A timer 55 operates the solenoid valve to alternately direct fluid into the cylinder 50 on opposite sides of the piston 56 at set time intervals.

Thus during the operation of the hydraulic wrench 11 a power source (not shown) supplies pressure to the reservoir 54 which is in fluid communication with the cylinder 50 through hydraulic lines 53 and hydraulic connection 52. Flow is periodically reversed by the timer 55 so that the cylinder 50 and integral cylinder pin 46 reciprocate back and forth along the piston rod 51. The timer can be set in conjunction with the pressure in the reservoir to allow application of higher or lower pressures. The higher the pressure, the less time the solenoid valve needs to supply fluid to one end of the cylinder 50.

The drive segment 30 is pivoted about the longitudinal or rotational axis of the output shaft 23 (FIG. 3) and its longitudinal axis is in axial alignment with the longitudinal axis of the output shaft. The drive segment 30 defines a lever arm which is oscillated by the reciprocating cylinder 50, supplying an additional mechanical advantage to the input force. As the drive segment 30 oscillates, the pawl 34 rotates ratchet drive wheel 26 and splined output shaft 23. As the drive segment 30 returns from a drive stroke the ratchet drive wheel 26 is maintained in position by the backlash lever 38. The cycle then continues until a threshold torque is exceeded, this torque being determined by the pressure of the hydraulic fluid.

Due to the correlation of hydraulic pressure and torque, extremely accurate and consistent torque can be applied to a threaded connection. Appropriate control and instrumentation systems (not shown) can be utilized to display hydraulic pressure in units of torque. To reverse the turning motion of the output shaft 23, the wrench is simply inverted so that the upper housing 12 is on the bottom and the lower housing 14 is on the top and the opposite end of the output shaft bore 24 is fixed to the socket being used.

Figure 5:
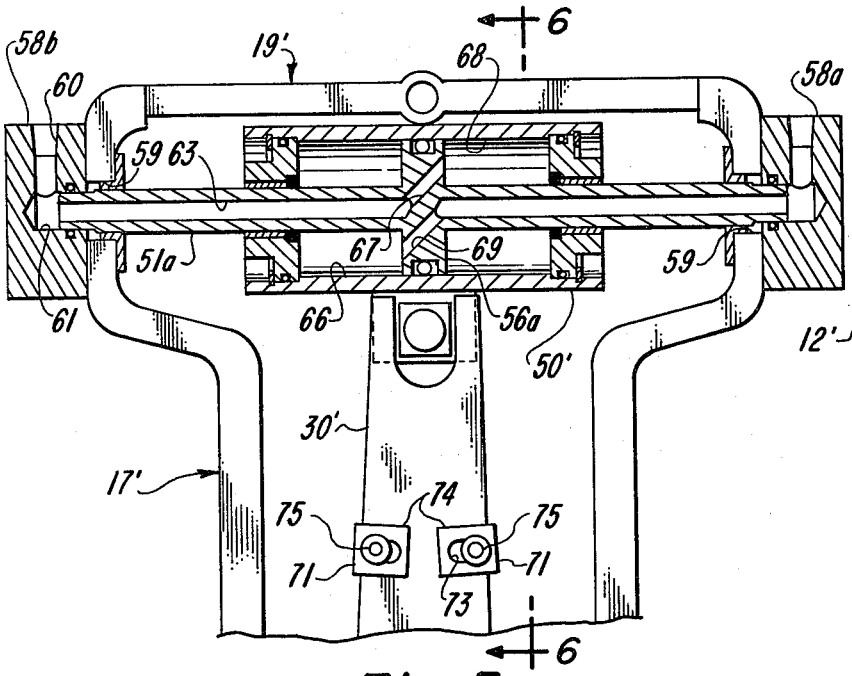
FIG. 5 is a partial top plan view of an alternative embodiment of the hydraulic torque wrench without an upper housing, a piston-cylinder combination being shown in section along a vertical plane through the piston-cylinder combination.
Figure 6:
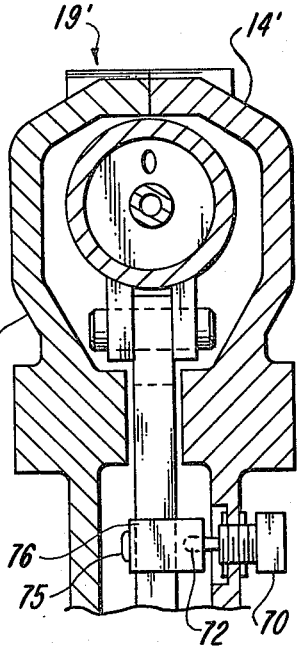
FIG. 6 is a section view taken along line 6—6 of FIG. 5.

An alternative embodiment of the invention is shown in FIGS. 5 and 6 and with like parts having been given like numerals with a prime suffix. In this embodiment the hydraulic fluid connection is made at the input end 19′ through a pair of fittings 58*a* and 58*b* connected to each side of the housing 17′ between the upper housing 12′ and the lower housing 14′. A circular opening 59, formed by a semicircular opening in both the upper and lower housings admits a portion of the fitting into the interior space defined between the upper and lower housings to rigidly retain the fitting therebetween.

The fittings 58*a* and 58*b* provide a fixed position for entry of hydraulic fluid, as compared to the movement of hydraulic connection 52, with the frictionally retained hydraulic lines 53, as the cylinder 50 reciprocates about piston 56, as has been previously described. The fittings therefore have a bore 60 entering the fittings from the input end 19′ for conventional connection to a hydraulic fluid source.

The piston rod 51*a* in this embodiment has been designed so that each end passes through the housing 17′, coaxial to the portion of the fittings 58*a* and 58*b* extending into the interior of the housing. The rod terminates at each end in a cavity 61 disposed within the fitting. The rod 51*a* has a first coaxial bore 62 along the length of the rod, in fluid communication with the cavity 61 and bore 60 of the fitting 58*a*, and a second bore 63 coming from the other fitting 58*b* in a similar manner.

The bores 62 and 63 terminate at a disc-like central portion or piston 56*a* of the rod 51*a*. At this termination point an angled passageway 64 associated with bore 62 provides fluid communication between bore 62 and volumetric space 66, defined by the volume between the interior surface of cylinder 50′ and the surface of the circular face of the piston 56*a* opposite the side where bore 62 enters the piston. In an identical manner, a second passageway 67 provides fluid communication between the second bore 63 and a volumetric space 68 within the cylinder 50 on the other side of piston 56*a*. Passageways 64 and 67 are parallel to each other as they pass through piston 56*a*.

In the alternative embodiment, a switch 70 having a toggle 72 is mounted in the lower housing 14′ along a longitudinal axis bisecting the wrench 11. The switch is positioned generally intermediate the length of drive segment 30′. A pair of triggers 71 are fixedly mounted by rivets or screws 75 to the drive segment 30. The triggers consist of a planar piece 74 of metal having a depending portion 76 extending downwardly along each side of the drive segment to a position below the toggle 72. The screws pass through a slot 73 in the planar portion of the trigger. As the drive segment oscillates alternatively one trigger 71 and then the other hits the toggle and activates the switch.

The triggers 71 can contact the toggle 72 early or late in the cyclic oscillation of the drive segment 30'. The timing of the switching results from moving the depending portion 76 of the trigger 71 in or out relative to the drive segment along slot 73 by releasing and then tightening the frictional connection between the triggers and the screws 75. The switch 70 in turn controls a valve of the type previously described for alternate admission of hydraulic fluid to first one fitting 58*a* and then the other fitting 58*b*.

In operation, hydraulic fluid is admitted through the valve (not shown) to the fittings 58*a* and 58*b* through bore 60 and into cavity 61. Communication through bore 62 along piston rod 51*a* allows the fluid to pass through the interior of the piston 56*a* by first passageway 65 into first volumetric space 66. As the volumetric space 66 is filled, cylinder 50' slides along rod 51*a* toward the source of fluid.

Once the switch 70 is struck by trigger 71, fluid is admitted through the fitting 58*b* into the second bore 63, second passageway 67 and into second volumetric space 68 causing movement of cylinder 50' in the opposite direction. This process is continued until such time as the desired amount of torque has been achieved based upon the hydraulic pressure available to operate the wrench 11.

While a specific form of the invention has been described and illustrated herein, it is to be understood that the same may be varied within the scope of the appended claims, without departing from the spirit of the invention.

It is claimed:

1. A wrench for rotating a work tool, comprising in combination:

a housing;

an output member rotationally connected to the housing and adapted to connect to said work tool;

a drive segment comprising an elongated member;

ratchet means operatively connecting one end of the elongated member to the output member, said ratchet means operatively converting pivotable oscillating motion of the elongated member into intermittent unidirectional rotating movement for the output member;

the other end of the elongated member having a slot formed therein;

a fluid piston and cylinder apparatus comprising a piston operatively connected in a substantially fixed position to the housing and a cylinder member reciprocatively movable with respect to the fixed position piston, said cylinder member having at least one pin extending outward therefrom into the slot in the other end of the elongated member of the drive segment, the pin and slot operatively converting reciprocating movement of the cylinder member into pivoting oscillating movement for the elongated member.

2. A wrench as defined in claim 1 wherein the other end of the elongated member includes a pair of forked portions operatively extending therefrom in a forked configuration, the forked portions extending on opposite sides of the cylinder housing, each forked portion having a slot formed therethrough, said cylinder member having a pair of cylinder pins extending outward therefrom, each of said cylinder pins extending into a slot in a different forked portion of the elongated member.

3. A wrench as defined in claims 1 or 2 wherein the one end of the elongated member comprises at least one concentric ring connected thereto and extending circumjacent the output member, said ratchet means operatively connecting the concentric ring with the output member.

* * * * *